US007108394B1

(12) United States Patent
Swarens

(10) Patent No.: US 7,108,394 B1
(45) Date of Patent: Sep. 19, 2006

(54) BUILT-IN LOW-GLARE LIGHT FIXTURES RECESSED IN CEILINGS AND WALLS

(76) Inventor: Ralph W. Swarens, deceased, late of LaVerne, CA (US); by Toni F. Swarens, legal representative, 1830 Olivewood St., LaVerne, CA (US) 91750

( * ) Notice: Subject to any disclaimer, the term of this patent is extended or adjusted under 35 U.S.C. 154(b) by 0 days.

(21) Appl. No.: 10/273,635

(22) Filed: Oct. 21, 2002

(51) Int. Cl.
*F21S 8/04* (2006.01)

(52) U.S. Cl. ..... 362/147; 362/364

(58) Field of Classification Search ..... 362/147, 362/148, 364, 365, 367, 368, 150
See application file for complete search history.

(56) References Cited

U.S. PATENT DOCUMENTS

| | | | | | |
|---|---|---|---|---|---|
| 1,799,304 | A * | 4/1931 | Logan | 362/147 |
| 2,465,248 | A * | 3/1949 | McCandless | 362/304 |
| 2,998,511 | A * | 8/1961 | Chan | 362/147 |
| 3,040,172 | A * | 6/1962 | Chan | 362/257 |
| 4,232,361 | A * | 11/1980 | Kelsall | 362/364 |
| 4,887,196 | A * | 12/1989 | Brown et al. | 362/364 |
| 5,075,831 | A * | 12/1991 | Stringer et al. | 362/365 |
| 5,921,655 | A * | 7/1999 | Nassim | 362/147 |
| 6,082,878 | A * | 7/2000 | Doubek et al. | 362/365 |
| 6,364,511 | B1 * | 4/2002 | Cohen | 362/368 |
| 6,511,208 | B1 * | 1/2003 | Kotovsky | 362/285 |
| 6,568,826 | B1 * | 5/2003 | Kotovsky | 362/147 |
| 6,588,922 | B1 * | 7/2003 | DeCicco | 362/364 |
| 6,701,676 | B1 * | 3/2004 | Kompelien | 52/19 |
| 2003/0029981 | A1 * | 2/2003 | Chadwick | 248/309.1 |

* cited by examiner

*Primary Examiner*—Ali Alavi
*Assistant Examiner*—Hargobind S. Sawhney
(74) *Attorney, Agent, or Firm*—J. E. McTaggart

(57) ABSTRACT

A line of recessed low-glare lighting fixtures provides a totally built-in architectural recessed appearance: a special cast mounting unit has a recessed duct portion formed integrally with a flat face flange portion defining a light-exit opening. The face flange portion becomes plastered in place in a wall or ceiling with the duct portion supporting the light source and associated components. In a main embodiment for ceiling deployment, the face flange portion is made square, the light-exit opening and the duct portion can be made circular or rectangular, typically square, In an offset hidden source embodiment, usually wall-mounted with a rectangular light-exit opening to "wash" either a ceiling or a floor region, the recessed duct portion is curved and shaped to serve as a reflector surface for desired illumination distribution. The light source can be incandescent, fluorescent or metal halide, in a selection of wattage ratings. The mounting unit can be cast in different sizes according to wattage ratings. Non-metallic casting material prevents plaster cracking.

3 Claims, 6 Drawing Sheets

BUILT-IN LOW-GLARE LIGHT FIXTURES RECESSED IN CEILINGS AND WALLS

FIELD OF THE INVENTION

The present invention relates to the field of built-in electric lighting products, and more particularly it relates to method and structure of a product line of low-glare light fixtures featuring a novel mounting unit, precast integrally from non-metallic plaster-compatible material, which becomes an integral part of the ceiling or wall to provide a clean smooth appearance.

BACKGROUND OF THE INVENTION

The evolution in both commercial and residential indoor lighting has been characterized by progress in two directions simultaneously: along with improvements in technical/functional efficiency and variety of options in the illumination produced, there is ongoing development in the styling and aesthetic aspects of indoor light fixtures and enclosures; particularly there has been increasing interest in low-glare lighting fixtures that are architecturally integrated and appear to be built-in as part of the original building construction.

Indirect lighting, defined by Webster as "lighting reflected, as from a ceiling, or diffused so as to provide an even illumination without shadows" has become predominant in various forms that eliminate the annoyance of glare from a small bare bulb in the field of vision. For a light source of given power, i.e. wattage, the perceived glare is a function of the intensity of the visible light source, and thus the glare becomes reduced proportionately as the size of the visible area of the light source is increased through the use of reflected or translucent diffusion techniques.

The glass walls of fluorescent tubes are diffused or "frosted" to reduce glare, and while often deployed directly in industrial and utilitarian environments, they are more likely to be deployed with the well-known translucent diffusion panel for residential and office purposes, to reduce glare by increasing the visible area of the light source.

Even further glare reduction is obtained by the well known practice of concealing the light source behind a baffle of some kind and arranging for the light to be directed to and reflected from a white or light-colored surface such as a room ceiling. This technique is found in many contemporary homes with the baffles located high on one or more walls, e.g. in drapery valences.

In another low-glare approach, multiple small fixtures recessed in a ceiling can be arranged to provide uniform low glare illumination: glare is reduced by recessing the light source deeply enough to conceal the source from view at virtually any room location other than directly beneath, where it would be necessary to tilt ones head back far enough to look straight up into the fixture.

Beyond the functional goal of minimizing glare, a great deal of effort has gone into developing light fixture structures that harmonize function and appearance by blending in with the architecture.

There has been creative development and deployment of low-glare "wash" type indirect lighting fixtures: e.g. directed to floors for safety and security, directed to walls in a special manner to create some specially desired ambiance or mood effect such as relaxation in a living room or quiet dignity in a public building. Such fixtures can be recessed into a wall or ceiling and may include a specially shaped built-in reflector; the source lamps may be hidden by an offset location or by a close-fitting opaque light baffle located centrally in a symmetrical unit with a pair of reflectors.

DESCRIPTION OF KNOWN ART

Amongst numerous U.S. patents disclosing indirect lighting fixtures of various categories, in the particular category of hidden offset lamp type with self contained reflectors, U.S. Pat. Nos. 4,748,543, 5,142,459 and 5,988,836 by the present inventor are incorporated herein by reference for purposes of describing the background and general principles of lighting products in this category.

Unlike well-known fluorescent fixtures that utilize diffusion panels, the fixtures disclosed in the above cited patents conceal the light source from direct view behind a light baffle and redirect the light with a built-in reflector.

The offset reflector "hidden source" type provides advantages in design flexibility: the reflector can be configured in a special asymmetrical shape to obtain particular illumination distribution objectives such as wash lighting directed to a targeted region which can be offset from the fixture, for example, a ceiling or floor region illuminated from a recessed wall fixture. With this category of indirect lighting, the viewer is generally unaware of the direct source of the light, whereas conventional translucent diffusing panels are highly visible and typically impose at least a moderate degree of glare.

In fixtures of well-known art used widely in suspended sub-ceilings, a rectangular diffusing panel is framed by surrounding inverted T-bar suspension rails and becomes, in effect, a recessed ceiling fixture. In the less common category of recessing into plastered ceilings and walls, including regular plaster or drywall, it has been necessary to provide some sort of decorative metal frame or molding around the perimeter of the fixture to hide the unavoidable gap between the opening in the ceiling or wall and the perimeter of the fixture.

Although such frames or moldings are often considered aesthetically undesirable and detrimental, there may be no way of eliminating them if they serve an essential function such as concealing unsightly structure or providing service/maintenance access that requires temporary removal or detachment. Built-in lighting structure of known art utilizing metal flashing covered with plaster have tended to subsequently develop cracks in the plaster due to the different thermal expansion properties of metal and plaster.

OBJECTS OF THE INVENTION

It is a primary object of the present invention to provide a low-glare lighting fixture configuration for recessed installation into a plastered wall or ceiling of usual plaster and drywall or gypsum lath construction, in a manner that does not require a frame or trim strip around the perimeter, with the result that the finished installation appears to be an integral original part of the wall or ceiling.

It is a further object that the lighting fixture be configured with provisions to facilitate wall or ceiling installation both in new construction and in pre-existing ceilings and walls.

It is a further object to provide an embodiment directed to the rectangular hidden-source, offset, curved internal reflector category.

It is a further object to provide embodiments directed to deeply recessed light sources in circular and square versions intended for ceiling installation.

It is a further object to provide for embodiments implemented with fluorescent, incandescent or metal halide lamps.

SUMMARY OF THE INVENTION

The above mentioned objects have been met by the present invention of a system of recessed low-glare lighting fixtures featuring a special mounting unit that can be cast from fiber-reinforced plaster and made in different sizes depending on wattage ratings, with a square or rectangular face flange configured with a rectangular, square or circular central light-exit opening from which a duct extends to the rear. The cast mounting unit supports a light source assembly that can be incandescent, fluorescent or metal halide, in a selection of wattage ratings, with components and wiring contained in or attached to a code-compliant enclosure. The assembly is readily installed via the mounting unit by regular tradesmen in new construction or retrofit. The mounting unit is fastened along the margins of the face flange to a stud frame formed in a ceiling or wall with the four edges of the face flange butt-joining adjacent drywall or gypsum plaster board. The joints are then taped and finish-plastered in a normal manner to provide a totally built-in integrated appearance with finish plaster extending uniformly to the edge of the light opening, with no need for molding or other trim parts. The electrical assembly connects to the AC power line in a normal manner. All replacement and maintenance can be performed from the room through the light-exit opening. An offset hidden source type fluorescent embodiment, with a curved mirror surface formed integrally in the mounting unit, can be wall-mounted, oriented to "wash" either a ceiling or a floor region.

BRIEF DESCRIPTION OF THE DRAWINGS

The above and further objects, features and advantages of the present invention will be more fully understood from the following description taken with the accompanying drawings in which.

DETAILED DESCRIPTION

Figure 1:
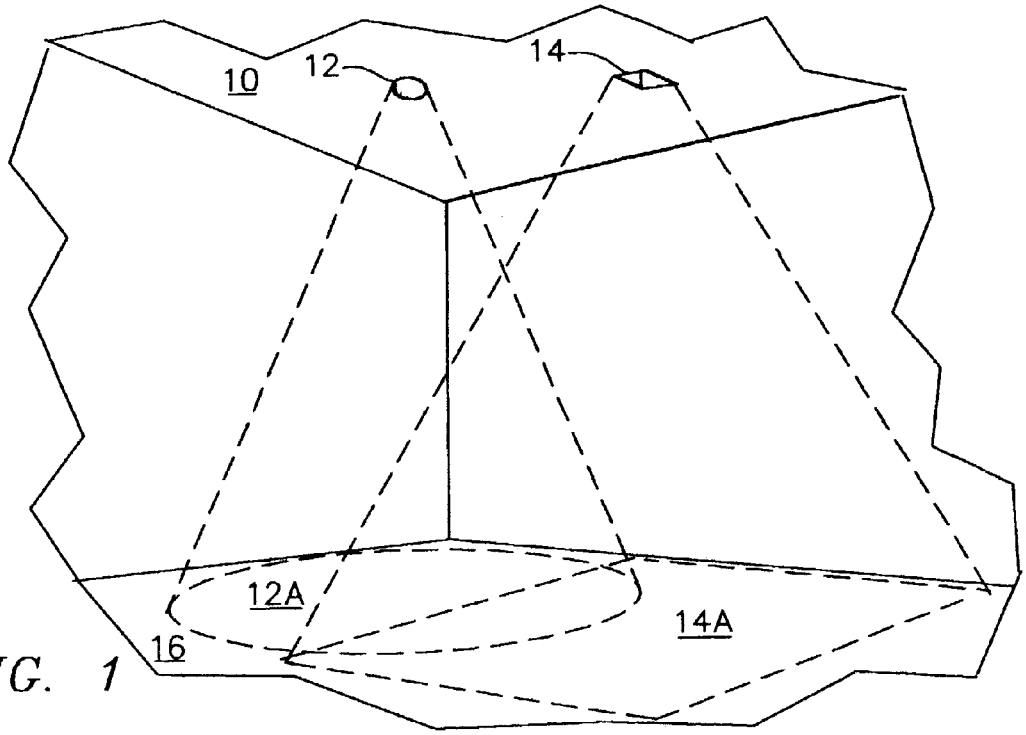
FIG. 1 is a perspective view of a corner portion of a room of which the ceiling is fitted with two low-glare light fixture embodiments of the present invention: a version with a circular light-exit aperture and another version and a square light-exit version.

FIG. 1, a perspective view of a corner portion of a room, shows the ceiling 10 fitted with two low glare light fixture embodiments of the present invention: a circular light-exit version 12 and a square light-exit version 14, producing fields of illumination, as indicated by dashed lines. that cover floor areas 12A and 14A respectively.

Figure 2:
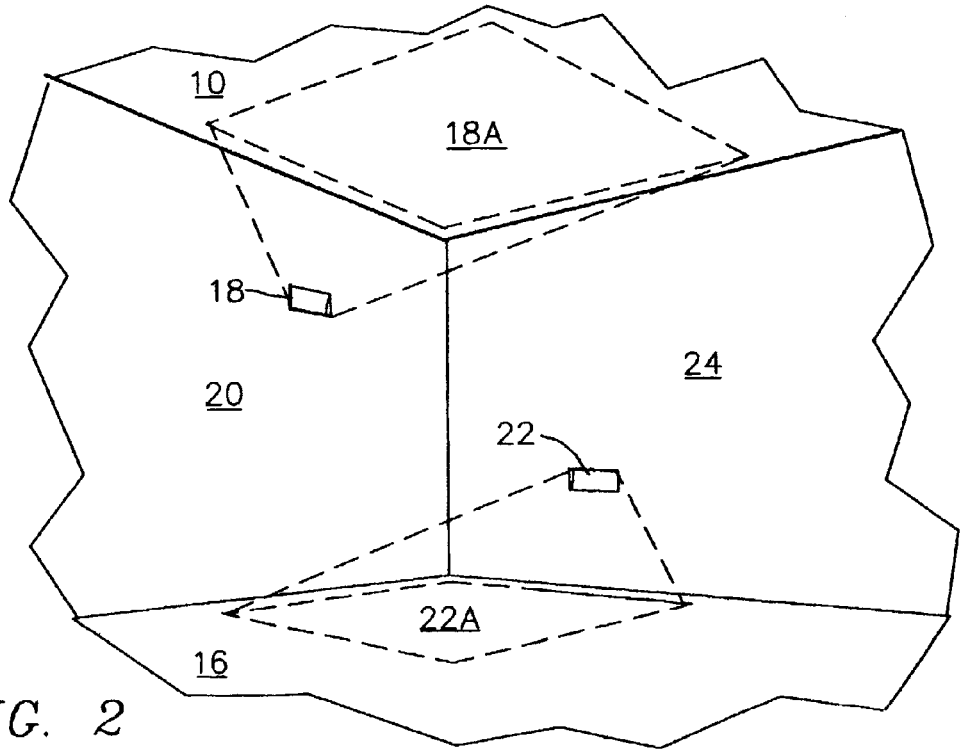
FIG. 2 is a perspective view of a corner portion of a room fitted with two low-glare offset type light fixture embodiments of the present invention: one installed on one wall directed upwardly to the ceiling, and one installed on the other wall directed downwardly to the floor.

The key feature of the invention that accomplishes the above described "built-in" architectural effect in both embodiments is the integral mounting unit 26, typically cast from a plaster compound, configured with two main portions: (1) flange portion 26A, in an orthogonal outer shape having edge regions configured to co-operate with surrounding drywall to form a standard drywall joint, to be spackled and become a permanent part of the building structure defining a light-exit aperture, and (2) contiguous with and extending from the light-exit aperture, the duct portion 26B serves as an interface adaptor for supporting the electrical components, which typically include an enclosure box, lamp, socket, wiring etc. These components become virtually hidden from room occupants, who (other than by looking up straight up from immediately beneath the fixture) can see only the regular wall or ceiling surface and a region of the inner wall of the duct portion 26B which is characterized by having essentially the same surface appearance as the surrounding wall or ceiling, visible through the light-exit aperture, as depicted in FIGS. 1 and 2. In all embodiments, mounting unit 26 is made integrally, typically cast from a plaster compound, typically fiber-reinforced gypsum, configured with two main contiguous portions: (1) a planar face flange portion 26A, having an orthogonal perimeter (i.e. rectangular, including square), surrounding a light-exit aperture opening of desired shape: typically circular or orthogonal, and (2) a duct portion 26B shapes as a column with its inner wall extending from the light-exit aperture to an end that interfaces with the associated electrical components, typically including a metal enclosure box. Due to its unique and novel shape and stand-alone appearance, mounting unit 26 has been dubbed the "top hat".

FIG. 2, a perspective view of a corner portion of a room, shows the walls fitted with two low glare offset type light fixture embodiments of the present invention: lighting fixture 18 installed on wall 20 directed upwardly to the ceiling 10, and lighting fixture 22, installed on wall 24, directed downwardly to the floor 16. In both cases, the recessed fixture has the appearance of a plaster "niche" built into the wall as an architectural feature, and the light source is hidden from the view of persons sitting or standing in the room.

Figure 3:
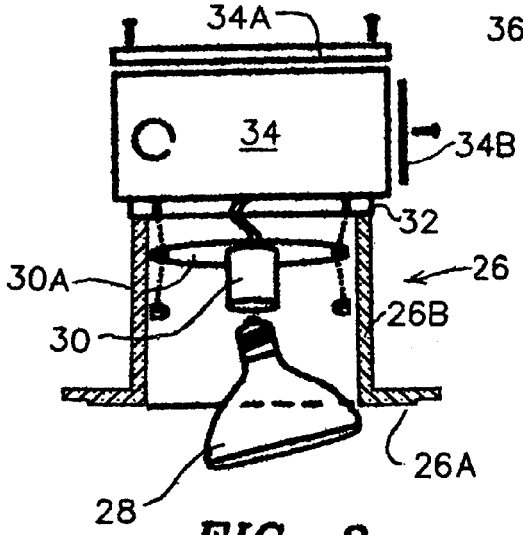
FIG. 3 is a functional side view of a version of the ceiling type light fixture of the present invention that utilizes a relatively low wattage incandescent lamp.

FIG. 3 is a functional side view of a low power incandescent version of a ceiling type light fixture embodiment of the present invention. A mounting unit 26, indicated in ghost outline to show electrical components in process of installation, is cast integrally from a fiber-reinforced plaster composition, to be built in to a ceiling and become the structural support and recessed light-exit aperture of the electrical fixture assembly.

Mounting unit 26 is configured with a square horizontal bottom face flange 26A having a central light-exit opening that can be made square or circular, from which a main hollow column extends upwardly typically six to eight inches to clear surrounding framing studs.

An incandescent lamp 28, which for this low power version can range up to 75 watts, screws into socket 30 which is attached to a metal mounting plate 30A that is removably attached to the bottom side of metal "top-hat" enclosure box 34, which is attached to a collar 32 attached on top of mounting unit 26. The "top-hat" enclosure box 34 is configured with knockouts for electrical cable attachment and fitted with access cover plates 34A on top and 34B on the side.

For this embodiment, the face flange 26A of mounting unit 26 is made 8½ inches square and the light-exit aperture dimension is made 4½ inches (diameter in the circular version/per edge in the square version).

Figure 4:
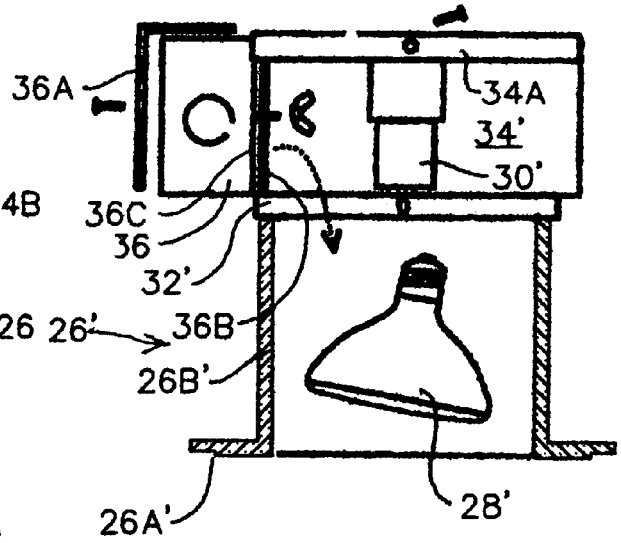
FIG. 4 is a functional side view of a larger version of the ceiling type light fixture of the present invention that utilizes a higher wattage incandescent lamps

FIG. 4 is a functional side view of a higher power version of the incandescent ceiling type light fixture embodiment of the present invention that is made larger than that described in connection with FIG. 3, so that the incandescent lamp 28' can range up to 150 watts. Socket 30' is mounted via a bracket to the lid 34A' of box 34' which is attached to mounting unit 26' via collar 32'. An electrical wiring hookup area 36 is fitted with an external cover plate 36A and an internal cover plate 36B which is retained in place by a pair of wing-nuts 36C that are accessible from below through mounting unit 26'. In a low power version, up to 90 watts, the face flange 26A' of mounting unit 26' is made 9¾ inches square and the light-exit aperture dimension is made 6 inches. In a higher power version, up to 150 watts, the face flange 26A' of mounting unit 26' is made 11¾ inches square and the light-exit aperture dimension is made 8 inches.

Figure 5:
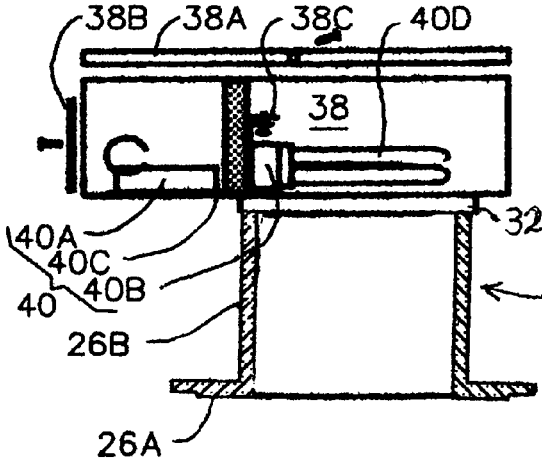
FIG. 5 is a functional side view of a fluorescent version of the ceiling type light fixture of the present invention.

FIG. 5 is a functional side view of a fluorescent ceiling type light fixture embodiment of the present invention. An elongated box 38, fitted with a top cover plate 38A and an end cover 38B, is supported on mounting unit 26' via the collar 32'. Box 38 surrounds and supports a fluorescent light assembly 40 that includes a ballast 40A, along with a pair of sockets 40B, mounted together on a Z-shaped mounting plate 40C and supporting a pair of U shaped fluorescent tubes 40D Assembly 40 is retained in place by a screw 40E traversing the upper flange of mounting plate 40C and engaging a bracket 38C affixed to box 38.

U-shaped fluorescent tubes 40D are engaged in socket 40B. Assembly 40 may have 1 or 2 quad or triple lamps, ranging from 13 watts to 42 watts.

In a low power version, up to 26 watts, the face flange 26A is made 9¾ inches square and the light-exit opening dimension is made 6 inches. In a higher power version, up to 42 watts, the face flange 26A' is made 11¾ inches square and the light-exit opening dimension is made 8 inches.

Figure 6:
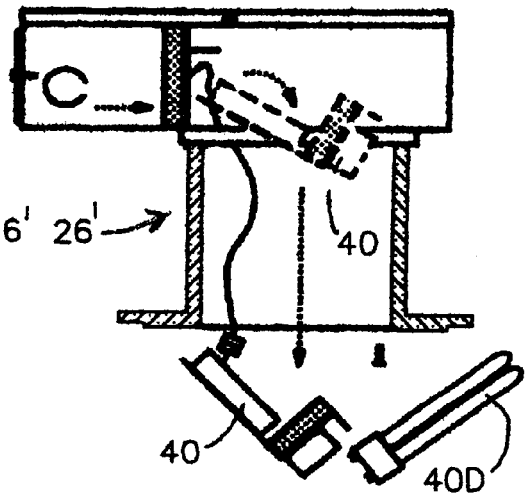
FIG. 6 shows the subject matter of FIG. 5 with the fluorescent lamp unit and its ballast in process of being removed for service or maintenance.

In FIG. 6, the subject matter of FIG. 5 is shown with the fluorescent lamp assembly 40 in process of being removed through the mounting unit 26' for service or maintenance purposes. Upon removal of tubes 40D and retaining screw 40E (FIG. 3) the assembly 40 is moved into the upper region as shown in dashed lines, then lowered through the mounting unit 26" as indicated by the arrow to the position shown below, where it can be disconnected and removed.

Figure 7:
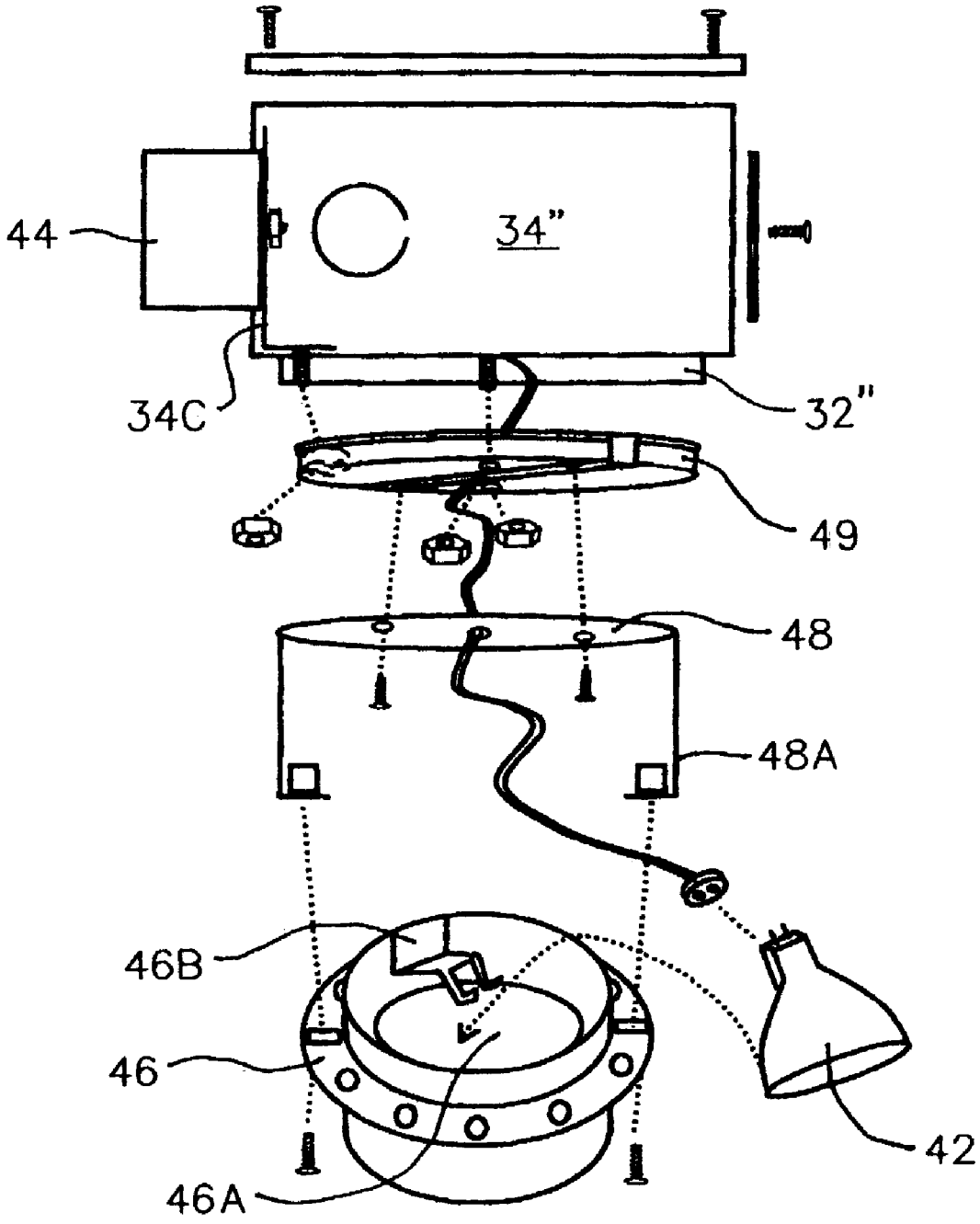
FIG. 7 is an exploded side view of a version of the ceiling type light fixture of the present invention utilizing a low voltage halogen lamp.

FIG. 7 is an exploded side view of a ceiling type light fixture embodiment of the present invention that utilizes a low voltage halogen lamp 42 and associated power transformer 44. Lamp 42 is supported in face down orientation by a lamp spinning 46 (spun from sheet metal) containing a lens 46A. Spinning 46 is attached by bolts through its edge flange engaging fixed nuts in arms 48A of metal holder 48, which is attached to access plate 49 by two screws, as shown. Access plate 49, which provides recessed regions on its lower side where insulation can be deployed, is attached to the bottom of "Top hat" wiring enclosure 34" by bolts extending downwardly and nuts accessible from below through the mounting unit, not shown in this figure. The collar 32" attaches the mounting unit to the "top hat" wiring enclosure 34" which is attached to access plate 49.

Power transformer 44 on one side, is attached to an L shaped bracket 34C which is held in place by a stud and nut, supplies low voltage to lamp 42 through a cable and connector as shown.

Figure 8:
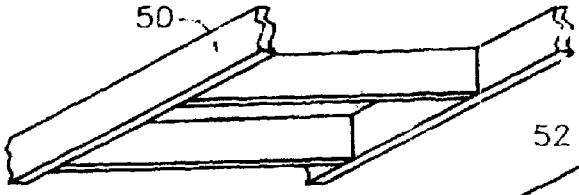
FIG. 8 is a perspective view of a square opening provided in building construction framing for installing a low-glare recessed light fixture of the present invention into a ceiling region.

FIG. 8 is a perspective view of building construction framework, typically of conventional "two by four" studs 50, configured to provide a square opening of specified size for installing a light fixture of the present invention into a ceiling region.

Figure 9:
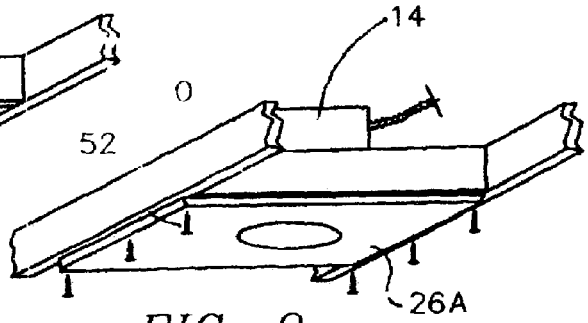
FIG. 9 depicts the subject matter of FIG. 8, with a light fixture mounting unit of the present invention being installed in place.

FIG. 9 depicts the subject matter of FIG. 8, with a light fixture 14 of the present invention being installed in place, preferably by a row of screws 52 engaging stud 50 through pre-drilled holes along a pair of opposite edges of the face flange 26A of the mounting unit, as shown.

Figure 10:
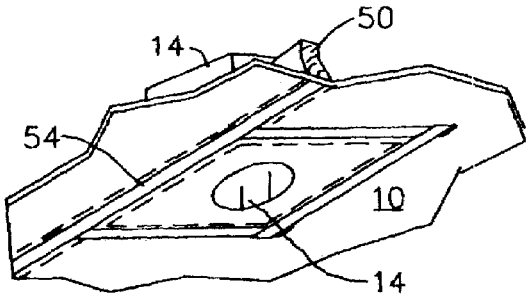
FIG. 10 depicts the subject matter of FIG. 9 with the addition of surrounding drywall board, with the peripheral joint taped ready to plaster.

FIG. 10 depicts the subject matter of FIG. 9 with the addition of drywall board 10 installed in place all around fixture 14, with the joint covered by drywall joint tape 54, ready for plastering.

Figure 10A:
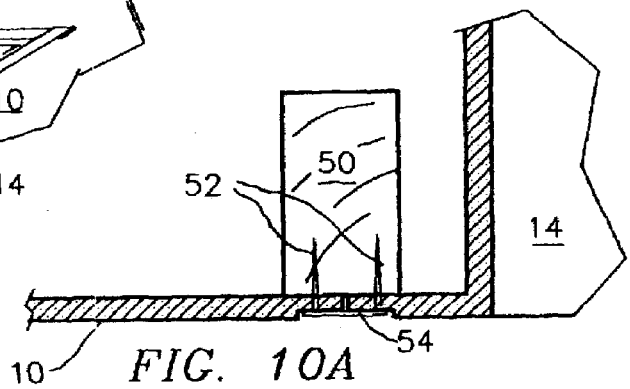
FIG. 10A is a cross-section taken at a lower edge of the light fixture of FIG. 10 showing the taped joint.

FIG. 10A is a cross-section taken at an edge of the face flange 26A of FIG. 10 showing the join covered by drywall joint tape 54, ready for plastering.

Figure 11:
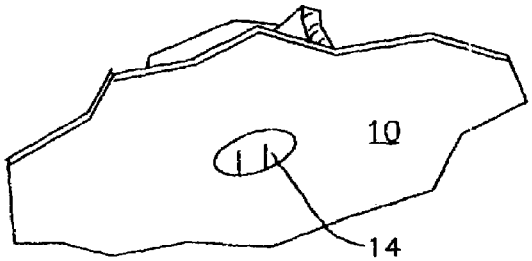
FIG. 11 depicts the subject matter of FIG. 10 with the addition of finish plaster, showing the final appearance.

FIG. 11 is a perspective view as in FIG. 10 with the addition of finish plaster 56, showing the final unified appearance of ceiling 10 with fixture 14 installed.

Figure 11A:
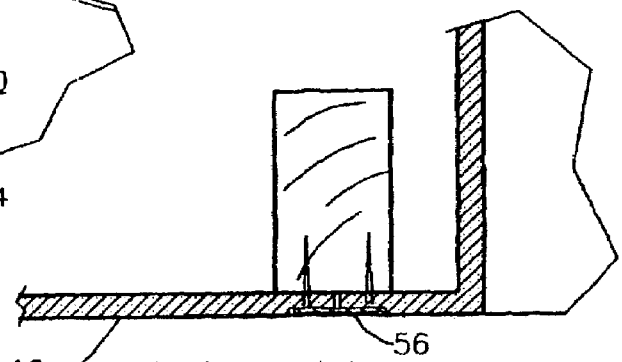
FIG. 11A is a cross-section taken at a lower edge of the light fixture of FIG. 11 showing the finish-plastered joint.

FIG. 11A is a cross-section as in FIG. 10A, with the finish plaster 56 applied, concealing the joints and tape 54 to give an integrated overall appearance, uniformly plastered to the edge of the light-exit opening in face flange 26A.

Figure 12:
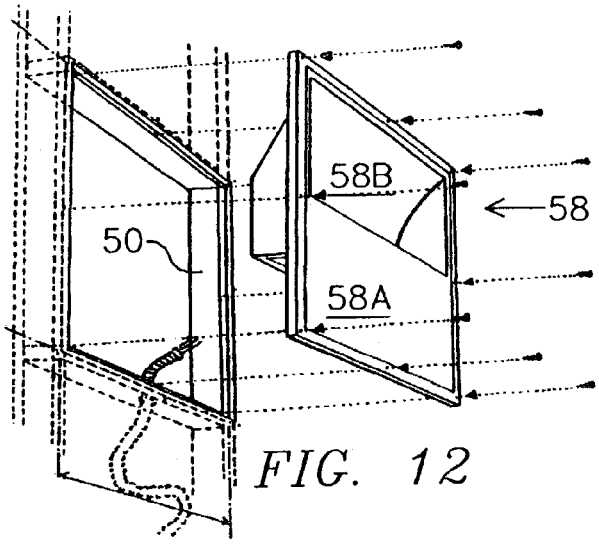
FIG. 12 is a three dimensional view of a fluorescent hidden source type of the present invention being installed into a framed wall opening.

FIG. 12 is a perspective view of another embodiment of the present invention: a rectangular hidden-source electrical fixture 58 of the offset type, shown here in incomplete pre-installation form. The mounting unit 58A differs from those described above in that the light-exit aperture is rectangular and offset to one side of the face flange, the other offset side being formed as a solid face flange region as shown; furthermore, instead of a straight duct as in the above described embodiments, the duct of the offset type mounting unit 58A is configured as a 90 degree elbow leading to a component mounting aperture at the inner end that is perpendicular to the light-exit aperture at the outer end. The light source is to be located in the offset region behind the solid face flange region of the cast mounting unit 58A. The curved interior of the elbow is made smooth and light in color to serve as a light reflector region 58B, and is specially shaped to provide a desired illumination distribution pattern, An electric power cable is shown, brought through a hole drilled in the lower studs.

Figure 13:
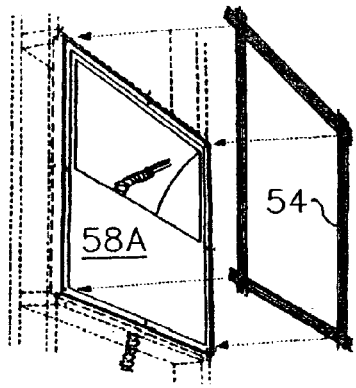
FIG. 13 shows the subject matter of FIG. 12 fastened in place in the wall ready for joint tape.

FIG. 13 shows the cast mounting unit 58 of FIG. 12 having been moved to the left into place and fastened, preferably with screws through drilled holes (as shown in FIG. 9). The surface of face flange 58A is made to be substantially flush with the surrounding wall region, forming a butt joint around the peripheral edges interfacing the surrounding plaster board, typically drywall type, ready at this stage to have drywall joint tape 54 applied over the peripheral butt joint.

Figure 14:
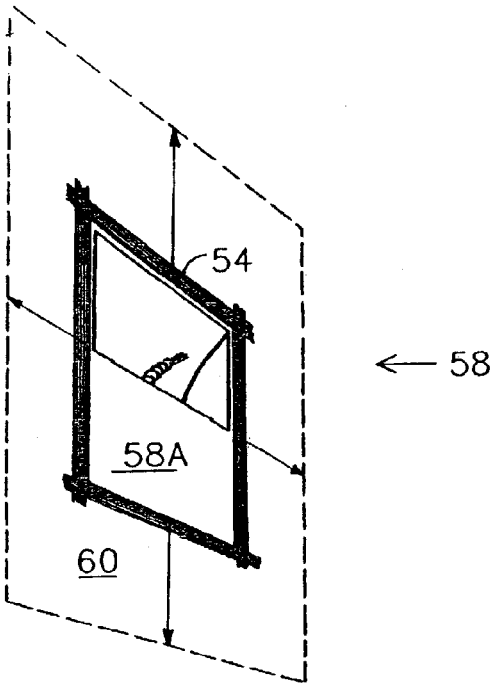
FIG. 14 shows the subject matter of FIG. 13 with the joint tape applied, ready for finish plaster.

FIG. 14 shows the subject matter of FIG. 13 the tape 54 applied over the peripheral butt joint between the edges of face flange 58A and the surrounding sheeting of wall 60.

Figure 15:
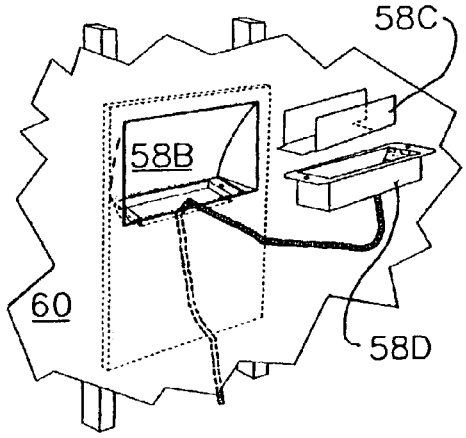
FIG. 15 shows the subject matter of FIG. 14 with components of the fluorescent lamp assembly connected and being installed.

FIG. 15 shows the subject matter of FIG. 14 following the finish plastering operation, showing a reflector component 58C and a main light source assembly, which may include a ballast, in enclosure box 58D, in process of being installed through the inner aperture at the bottom of reflector region 58B in the cast mounting unit, after having been connected to the electrical cable.

Figure 16:
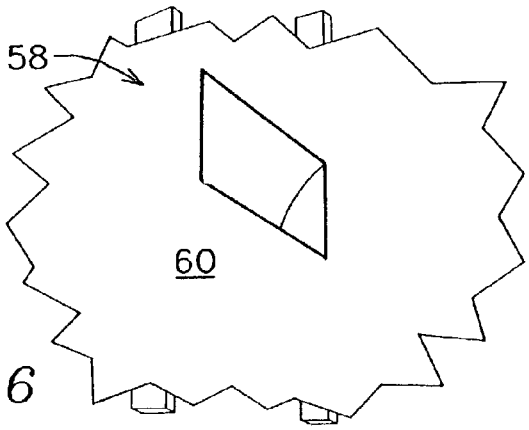
FIG. 16 shows the subject matter of FIG. 15 in finished form at the completion of installation.

FIG. 16 is a perspective view showing the appearance of the subject matter of FIGS. 12–15 in finished form at the completion of installation, with the light fixture 58 recessed in wall 60 and providing a totally built-in appearance such that the solid face flange region of the cast mounting unit blends in completely with the surrounding surface of the wall 60, and all that remains visible to room occupants is the recessed reflector surface.

Figure 17:
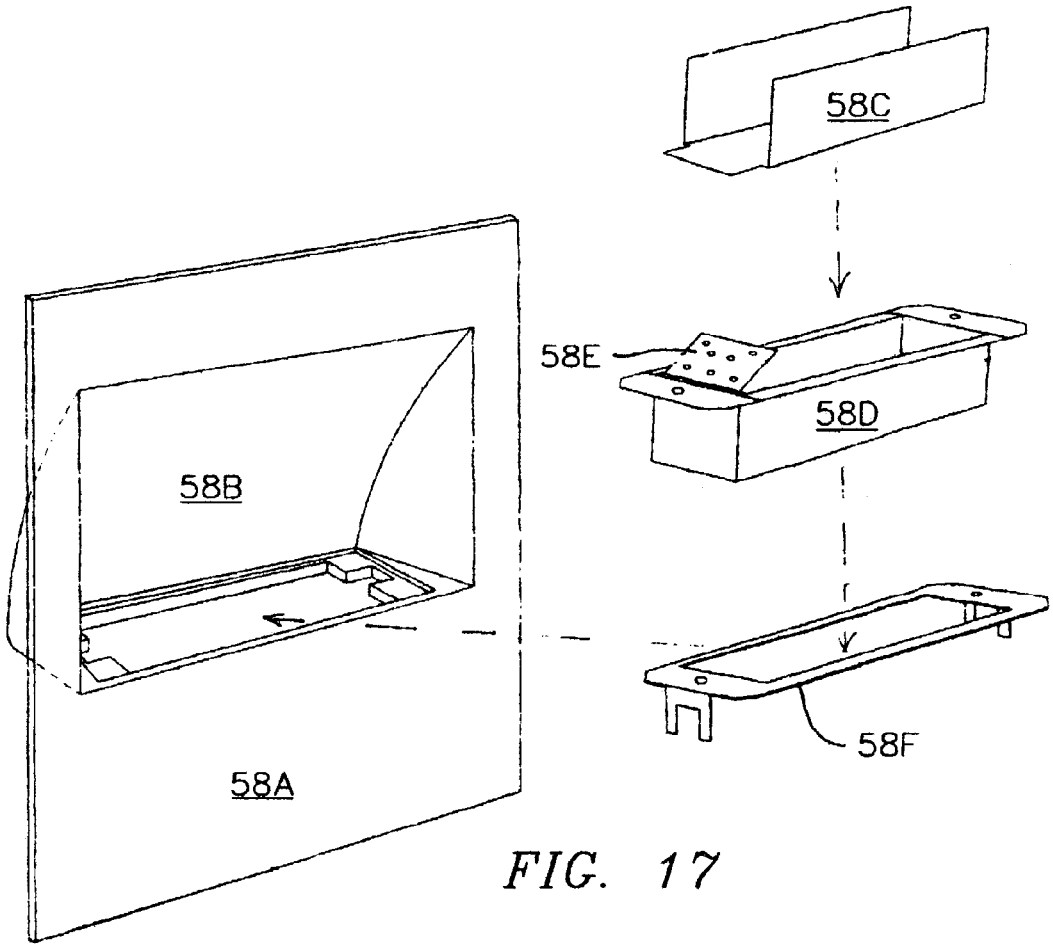
FIG. 17 is an enlarged three dimensional view of the major components of a further developed version of the subject matter of FIGS. 12–16

FIG. 17 is a three dimensional view of the major components of a further developed version of the wall mounted fixture of FIGS. 12–16: the integrally cast wall-mount unit formed with flat face flange 58A and the recessed curved light reflector region 58B. The horizontal shelf lip formed in the casting at the bottom of reflector region 58B is configured with the opening shown, specially shaped to receive metal mounting frame 58F, with four tabs extending downwardly that are bent outwardly around the shelf lip to retain frame 58F in place. Then the enclosure box 58D with a surrounding top flange is lowered into place through the opening in mounting frame 58F and fastened by screws through the two end flanges, engaging nut inserts in frame 58F. The reflector channel 58C is lowered into box 58D.

A two-piece socket mounting hinge 58E provides a mounting plate, drilled for attachment to one or more lamp sockets, hingedly attached to a smaller plate that is attached to the end of box 58D, with the hinge pin located along the top edge.

Figure 18A:
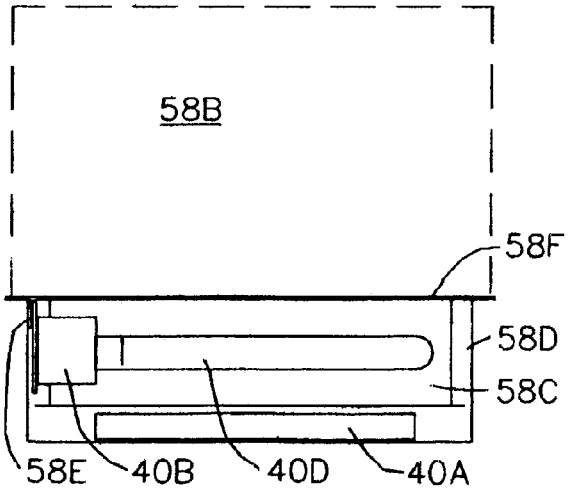
FIG. 18A is a cutaway front view of the subject matter of FIG. 17 showing a fluorescent lamp and socket in the normal horizontal working position.

FIG. 18A is a cutaway front view of the components of FIG. 17 assembled and containing a fluorescent lamp 40D engaged in lamp socket 40B which is mounted onto the mounting hinge 58E. Socket 40B and lamp 40D rest gravitationally in this horizontal operating position with the mounting plate against the end of box 58D.

A ballast unit 40A is mounted to the bottom panel of box 58D, beneath reflector channel 58C. The location of frame 58F (immediately beneath the surrounding top flange of box 58D) is indicated, and the light exit opening surrounding reflector region 58B is indicated in broken lines.

Figure 18B:
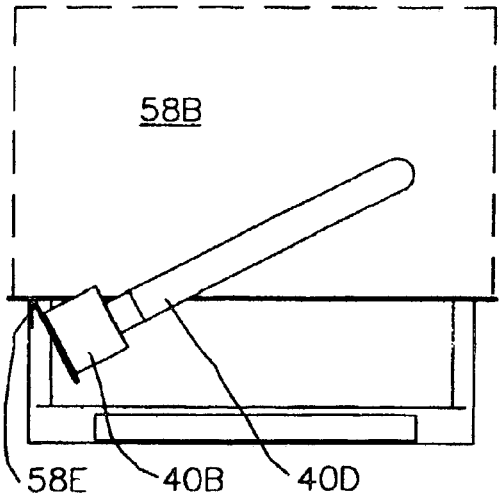
FIG. 18B shows the subject matter of FIG. 18A, showing the lamp and socket rotated upwardly on the hinged mounting plate to an inclined service position.

FIG. 18B shows the subject matter of FIG. 18A with the lamp 40D and socket 40B rotated upwardly about the pin of mounting hinge 58E to a service position extending up into the reflector region 58B for removal or installation of the lamp 40D, which would otherwise be difficult or even dimensionally impossible.

The combination of mounting frame 58F and the socket mounting hinge 58E greatly facilitates installation and assembly of the recessed wall fixture by allowing the flexibility of a number of options in the initial installation and assembly: the cast unit with face flange 58A and curved reflector region 58B, optionally with frame 58F in place, can be handled alone during the construction phase of installation and even including the plastering, then the mechanical components, i.e box 58D, can be installed, and then, in the electrical wiring phase of construction, lamp socket 40B and ballast transformer 40A can be easily mounted and wired. Then, in final assembly, the reflector channel 58C and lamp 40D, having been kept protected from damage, can be easily installed to complete the installation. Furthermore this construction greatly facilitates lamp replacement, cleaning, service and other maintenance requirements.

The offset type of fixture, shown in FIGS. 12–18B, is typically deployed in a wall location to "wash", (i.e. uniformly illuminate) a ceiling region (e.g. region 18A in FIG. 2), for which the fixture 58 is oriented as shown in the present examples. For a floor region (e.g. region 22A in FIG. 2) the orientation of mounting unit 58 would be reversed to direct the light downwardly. As a further option, an offset fixture can be installed in a ceiling to "wash" a designated wall. It can be made available in various aspect ratios so the light aperture can be square or rectangular; dimensions range typically from 13 inches to 50 inches in width and 6 inches to 18 inches in height. The fluorescent lamp can be the folded U shape type or the straight tubular type, and can be used in multiples enabling options ranging from 5 to 54 watts. Optionally regular incandescent or halogen lamps may be provided, typically in a range of 40 to 75 watts.

An optional flat panel or lens of polycarbonate or other suitable plastic can be provided and installed on the top flange surface of enclosure box 58D for purposes of security, safety or modifying the light distribution.

All of the foregoing embodiments are configured to anticipate the typical inaccessibility of the rear portion of the fixture behind the wall or ceiling, therefore they are configured in a manner to provide access from the room location, through the main light opening, for all anticipated maintenance and service work such as replacement of lamps, ballasts and transformers.

For all of the foregoing embodiments, the casting material for the mounting unit that has proven satisfactory is a composition of fiber and plaster that provides a finish that adheres to and reacts to plaster in substantially the same manner as regular drywall or gypsum plaster board. The fiber adds reinforcement for strength. Typically the thickness of the face flange is made ⅝" since this is the thickness of regular drywall construction; the duct walls are made about the same thickness, with a slight taper as a draw allowance for casting.

The main concept of the invention, i.e. forming a portion of the fixture as a plaster-compatible mounting unit be plastered in place for integration with the surrounding wall or ceiling, can be applied to practically any known type of light source in the same manner as shown above for popular types of light sources.

While casting from a composition of plaster material such as gypsum with fiber reinforcement is suggested as the preferred manner and material for fabrication of the mounting unit, having the appearance, and working properties of standard drywall material and meeting applicable building regulations, the invention could be practiced using other fabrication methods such as molding, utilizing other compatible material such as concrete or plastic and other suitable reinforcing material such as carbon fiber. It is recommended to use only non-metallic materials since the thermal coefficient of expansion of metal, being substantially different from that of plaster and drywall, can introduce risk of plaster cracks in the region around the light-exit aperture.

Practice of the present invention is not limited to indoor locations as described above: outdoor and/or "wet" locations can also be accommodated by selection of materials and by other weather-proofing measures of known art as a matter of design choice.

The invention may be embodied and practiced in other specific forms without departing from the spirit and essential characteristics thereof. The present embodiments are therefore to be considered in all respects as illustrative and not restrictive, the scope of the invention being indicated by the appended claims rather than by the foregoing description; and all variations, substitutions and changes which come within the meaning and range of equivalency of the claims are therefore intended to be embraced therein.

What is claimed is:

1. A low-glare light fixture mounting system for permanent recessed installation of a light fixture in a flat region selected from walls and ceiling of a room, comprising:

a preformed mounting unit structured as a single piece of uniformly-distributed non-metallic drywall-plaster-compatible material configured with two main portions: (1) a planar face flange portion, configured with a rectangular light-exit aperture, the planer face flange portion extending from the light-exit aperture to a rectangular periphery with four edges, the light-exit aperture being offset toward a first edge of the face flange portion such that the light-exit aperture is bordered on three sides by a relatively narrow margin and on a fourth side by a relatively wide offset panel region of the face flange portion, and (2) a duct portion having a first end integrally contiguous with the face flange portion and having an inner surface extending from the light-exit aperture to a second and opposite end constituting an open attachment end with a peripheral rim made and arranged to engage and support a fixture housing enclosing a light source, the duct portion being configured to form a right-angled elbow having a generally four-sided cross-sectional shape that transitions from conformance with the rectangular shape of the light-exit aperture at the first end to a smaller, generally rectangular attachment end, which is made to be substantially perpendicular to the face flange portion, and oriented in a direction to become located behind the offset panel region of the face flange portion; and a light source assembly, including (a) an enclosure box, (b) at least one lamp and associated socket attached to the enclosure box, (c) attachment means for joining the enclosure box, lamp and socket to the attachment aperture end of the duct portion so as to direct light emitted from the lamp through the duct portion and the light-exit aperture, and (d) electrical wiring and associated electrical components as required for electrical installation and power line connection in accordance with conventional building practices and regulatory requirements;

said preformed mounting unit being made and arranged to be fastened to building construction framing and to interface with surrounding sheet building material in a manner to facilitate conventional drywall taping and finish plastering and to yield a uniform finished surface in a common flat plane extending from the surrounding flat region to the light-exit aperture, and components located so as to direct light therefrom through the light-exit aperture, while presenting, to a room occupant, a continuous region of uniform surface structure and appearance that extends from the surrounding sheet building material and includes visible areas of the planar face flange portion and the inner wall of the duct portion.

2. The low-glare light fixture mounting system as defined in claim 1 further comprising:

a generally rectangular mounting frame made and arranged to be attached to the opposite end of the duct portion in a substantially horizontal disposition, to accommodate insertion of the enclosure box through a rectangular opening configured in the mounting frame and to provide mounting and retention of the enclosure box as a downward extension of the duct portion.

3. The low-glare light fixture mounting system as defined in claim 1 further comprising:

a two-part socket mounting hinge having a first plate made and arranged to attach to and support at least one lamp socket and having a second and smaller plate, hingedly attached to the first plate, made and arranged to attach to an end of the enclosure box so as to hinge along a top region thereof and thus provide a normal working location wherein the socket and lamp rest gravitationally in a substantially horizontal disposition as well as capability of an inclined service location to which the socket and lamp can be rotated upwardly for purposes of facilitating initial assembly, lamp installation, lamp replacement, cleaning and maintenance.

* * * * *